United States Patent [19]

Nakanishi

[11] 4,090,535

[45] May 23, 1978

[54] APPARATUS FOR FORMING TUCKED-IN TYPE SELVAGES ON A SHUTTLELESS WEAVING LOOM

[76] Inventor: Toyo Nakanishi, 2-19, Motomachi 1-chome, Katsuyama-shi, Fukui-ken, Japan

[21] Appl. No.: 733,117

[22] Filed: Oct. 18, 1976

Related U.S. Application Data

[63] Continuation of Ser. No. 604,033, Aug. 12, 1975, abandoned.

[30] Foreign Application Priority Data

Aug. 21, 1974 Japan ..... 49-95086

[51] Int. Cl.[2] ..... D03D 47/48

[52] U.S. Cl. ..... 139/434; 139/450; 139/194

[58] Field of Search ..... 139/430, 434, 450, 194, 139/195

[56] References Cited

U.S. PATENT DOCUMENTS

| | | | |
|---|---|---|---|
| 3,441,059 | 4/1969 | Gotz et al. | 139/430 |
| 3,499,474 | 3/1970 | Pfarrwaller | 139/431 |
| 3,563,280 | 2/1971 | Cugini | 139/431 |
| 3,844,316 | 10/1974 | Palencher | 139/302 |

*Primary Examiner*—Henry S. Jaudon

[57] ABSTRACT

Formation of tucked-in type selvages on a shuttleless weaving loom is carried out in the area in front of the reed by cooperation of a pair of coacting grippers and a cutter, movements of these elements being in the form of a combination of swinging about a fixed point and sliding in the warp direction, the course of movement of the grippers before cutting of the weft end being different from that after cutting of same.

13 Claims, 17 Drawing Figures

APPARATUS FOR FORMING TUCKED-IN TYPE SELVAGES ON A SHUTTLELESS WEAVING LOOM

This is a continuation of application Ser. No. 604,033, filed Aug. 12, 1975 now abandoned.

BACKGROUND OF THE INVENTION

The present invention generally relates to method and apparatus for forming tucked-in type selvages on a shuttleless weaving loom, and more particularly relates to an improvement in the operation and construction of the grippers which coact with the needle for inserting the weft end to be tucked-in into the open shed.

In the case of the conventional grippers used in the formation of tucked-in type selvages on a shuttleless weaving loom, it is necessary, from a constructional point of view, to provide a gripping operation across the reed of the loom. Especially in the case of woven cloths of relatively larger weaving shrinkage, this characteristic feature of the gripping operation should lead to formation of elongated tucked-in type selvages, the rate of elongation corresponding to the weaving shrinkage of the woven cloths.

Further, in the conventional arrangement, the grippers are driven directly from a cam or a like mechanism mounted on a shaft which rotates in synchronism with the driving shaft of the weaving loom. When it is desired to afford the grippers a complicated movement, e.g. a movement given in the form of a combination of a vertical movement with a horizontal movement, the aforementioned conventional driving system inevitably requires a considerably complicated and enlarged mechanical construction.

BRIEF DESCRIPTION OF THE INVENTION AND OBJECTS

A principal object of the present invention is to provide method and apparatus for forming tucked-in type selvages on a shuttleless weaving loom without elongation of the selvages so formed even when the woven cloths have relatively large weaving shrinkage.

Another object of the present invention is to provide method and apparatus for successfully and reliably forming tucked-in type selvages on a shuttleless loom which has a simple and compact construction.

In order to attain the aforementioned objects, the operational area of the grippers according to the present invention is taken on the front side of the reed of the loom and the course of movement of the grippers before cutting of the weft ends is designed to be different from that after cutting of same. The grippers and the cutter are driven for the prescribed movements by a pair of separate control mechanisms related thereto via intermediate elements. The movements of the grippers and the cutter are in the form of a combination of swinging about a fixed point on the loom framework together with a sliding movement in the warp direction of the intermediate elements.

In the commercial embodiment, a separate set of grippers is disposed on each side of the material being woven such that a tucked-in selvage may be formed on either side of the material. For purposes of simplicity, however, only one set of grippers and its associated control apparatus will be described herein.

In the following description, positions on the side close to the reed will be referred to with the term "rear" and movements towards the reed will be referred to with the term "rearwardly" whereas positions on the side remote from the reed will be referred to with the term "forward" and movements away from the reed will be referred to with the term "forwardly".

BRIEF DESCRIPTION OF THE FIGURES

Further features and advantages of the present invention will be made clearer from the ensuing description with reference to the embodiment shown in the accompanying drawings, in which.

DETAILED DESCRIPTION OF THE INVENTION

Figure 1:
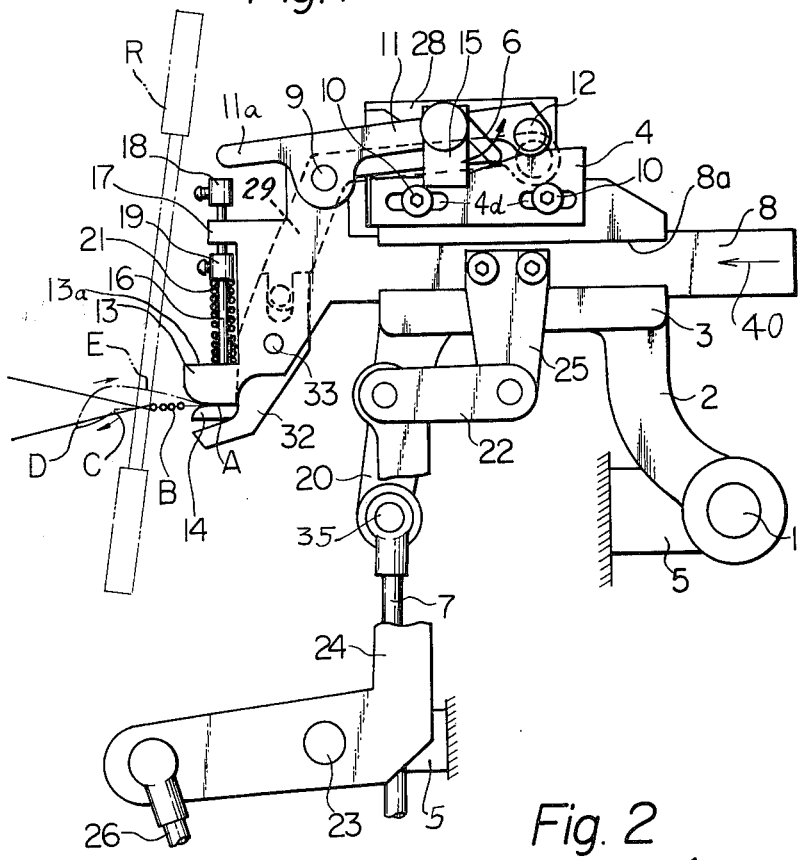
FIG. 1 is a side elevational view, with certain parts omitted therefrom, of one embodiment of the apparatus of the present invention.
Figure 2:
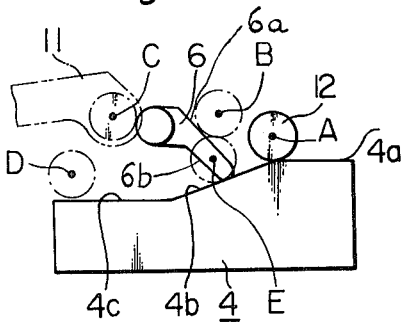
FIG. 2 is an explanatory diagrammatic side elevational view of the gripper stand and its related parts used in the apparatus shown in FIG. 1.

One preferred embodiment of the present invention is shown in FIGS. 1 through 4, in which a gripper arm 2 is pivoted, at its lower end, at a pin 1 fixed to a proper portion of the loom framework 5. Gripper arm 2 carries at its upper end a gripper bracket 3 on which a gripper stand 4 is fixed by set screws 10. This securement is established via slots 4*d* formed through the gripper stand 4 so that the position of the gripper stand 4 can be adjusted relative to the reed R. As shown in FIG. 2, the gripper stand 4 is provided, on its upper surface, with three cam portions, i.e. a forward flat portion 4*a*, a sloping portion 4*b* sloping down rearwardly and a rear flat portion 4*c*. Another bracket 15 is fixedly mounted to the upper side of the gripper stand 4, upon which a gripper cam 6 accompanied with a return spring (not shown) is pivoted.

The gripper bracket 3 is provided, at the bottom of its rear end with an arm 20 whose lower end is pivotally coupled by pin 35 to one end of the first rod 7. The other end of this first rod 7 is connected to a proper control mechanism (not shown) in such a manner that, when the first rod 7 is driven for vertical movement, the gripper bracket 3 and its annexed parts awing vertically about the pin 1.

A guide groove 8*a* is formed almost horizontally in the gripper bracket 3 and a gripper slider 8 is received in the guide groove 8*a* and is slideable towards and away from the reed R. A gripper lever 11 is pivoted, on its rear end portion, on a pin 9 fixed to the top rear end of the gripper slider 8. The rear end of gripper lever 11 is so designed as to act on the operator rod (to be subsequently described) so that the forward end of the gripper lever 11 rotatably carries a gripper roller 12. The gripper roller 12 rests upon the upper surface of the gripper stand 4, which, as already explained, is composed of the forward flat portion 4*a*, the slope 4*b* and the rear flat portion 4*c*. The gripper roller 12 also operates under the control of the gripper cam 6.

The lower rear end portion of the gripper slider 8 forms an upper gripper 13. This upper gripper 13 is so designed as to coact with a lower gripper 14. In order to carry the lower gripper 14, a projection 17 is formed on the upper rear end side of the gripper slider 8 to slideably receive the aforementioned vertically aligned operator rod 16. An adjust collar 18 and a set collar 19 are annexed to the operator rod 16 in order to adjust and fix the vertical position of the operator rod 16. The operator rod 16 carries, at its bottom end, the lower gripper 14. A helical tension spring 21 surrounds rod 16 and is positioned between the set collar 19 and the shoulder 13*a* of upper gripper 14 in order to normally urge the lower gripper 13 upwardly into resilient pressure contact with the upper gripper 13.

A bracket 25 is fixed to gripper slider 8, and is linked to one end of an L-shaped lever 24 (shown partially broken away) via a connector 22. The L-shaped lever 24 is pivotally mounted upon pin 23 fixed to the framework 5 and another end thereof is pivotally coupled to one end of a rod 26 driven by the control mechanism causes corresponding and substantially horizontal movement of the gripper slider 8 and its annexed parts to and away from the reed R.

Figure 3:
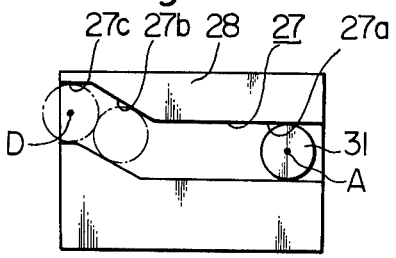
FIG. 3 is an explanatory diagrammatic side elevational view of the cutter cam and its related parts used in the apparatus shown in FIG. 1.

A cutter cam 28 is fixed to gripper bracket 3 at a position close to the gripper stand 4. As shown in FIG. 3, cutter cam 28 is provided with a cam groove 27 which is composed of a forward flat portion 27*a*, a slope 27*b* rising rearwardly and a rear flat portion 27*c*.

Figure 4:
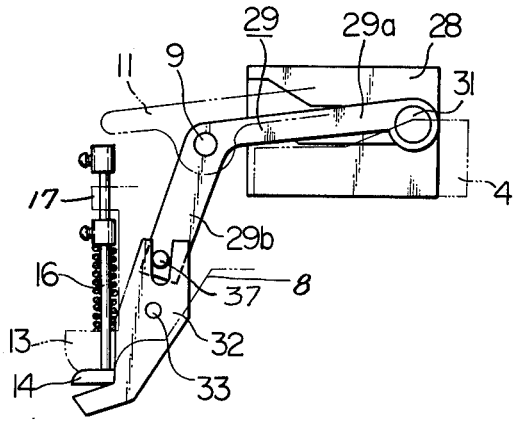
FIG. 4 is an explanatory side elevational view of the cutter lever and its coacting parts used in the apparatus shown in FIG. 1.

As shown best in FIG. 4, pin 9, which carries the aforementioned gripper lever 11, further swingably carries an inverse L-shaped cutter lever 29 at its apex. The substantially vertically aligned arm 29*b* of the cutter lever 29 is joined to a cutter 32 by pin 37. The cutter 32 is pivotally joined sideways to the forward lower portion of the gripper slider 8 via pin 33.

Figure 7:
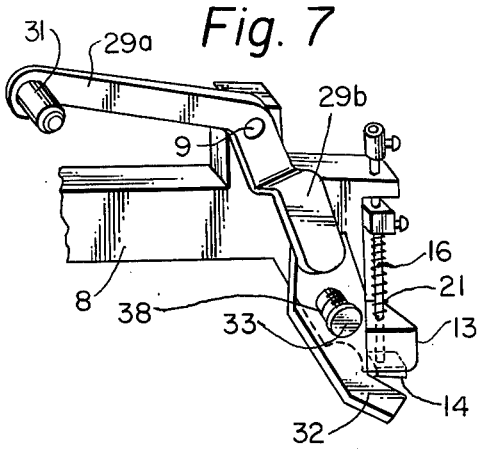
FIG. 7 is an explanatory side elevational view of the cutter lever and some of its coacting parts used in the apparatus of FIG. 1.
Figure 7A:
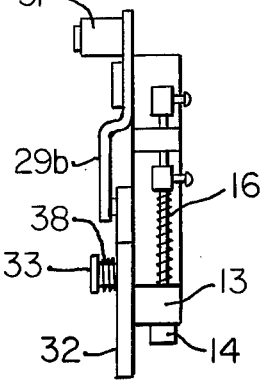
FIG. 7A is a front view of FIG. 7.

As best illustrated in FIG. 7, a spring 38 fixedly attached at one end to pin 32 and at the other end to cutter 32 urges cutter 32 in a clockwise direction (as viewed in FIG. 7) away from upper gripper 13. When the weft is gripped between upper gripper 13 and lower gripper 14, and cam follower 31 reaches rear flat portion 27*c* (see FIG. 3), arm 29*b* is pivoted downwardly about pin 9 causing cutter 32 to pivot in a counter clockwise direction. The rotation of cutter 32 towards upper gripper 13 causes the gripped weft to be cut by the cooperation of the sharp edges of cutter 32 and upper gripper 13 (see FIG. 7*a*).

The gripping operation on the apparatus of the present invention is carried out in the form of a combination of two separately driven movements, i.e. a swinging movement driven by first rod 7 via the gripper bracket 3 and the forward and rearward movement driven by the second rod 26 via the gripper slider 8. This combined movement will now be explained with reference to FIG. 5.

The grippers start from a position A and move rearwardly (under control of rod 26) towards a position B just in front of the cloth fell position at which the grippers open in order to catch the weft. Next, the grippers further advance rearwardly and downwardly passing the cloth fell position. Upon arrival at position C, the grippers catch the weft and close in order to grip the weft. While gripping the weft caught therebetween, the grippers further move rearwardly and downwardly toward position D, at which the cutter operates to cut off the weft. After this cutting operation, the grippers move forwardly and upwardly along a course different from the rearward movement course. Upon arrival at a position E, the grippers cause the weft to be hooked by the hook of the needle. At position E, the needle advances into the open shed and the tension caused thereby pulls the weft out from between the grippers. The grippers then move further forwardly and downwardly in order to resume the starting position A.

In order to complete the aforementioned procedure, the grippers are required to open at the position B, close at the position C and maintain the open state until arriving at position E. Further, in order to successfully cause the weft to be hooked by the hook of the needle, it is required that the distance AC (between the positions A and C) should be larger than the distance AE (between the positions A and E). When this difference P exceeds a certain prescribed value, hooking of the weft can be practiced without fail.

The aforementioned gripping operation will hereinafter be explained in more detail in sequential order, reference being made mainly to FIGS. 2 through 5, 6A through 6E and 8A through 8E. FIGS. 8A through 8E illustrate the position of the grippers with relation to the woven material F, the warps T and the weft W. The progressive location of the hooking needle 41 is also illustrated in schematic form.

Figure 5:
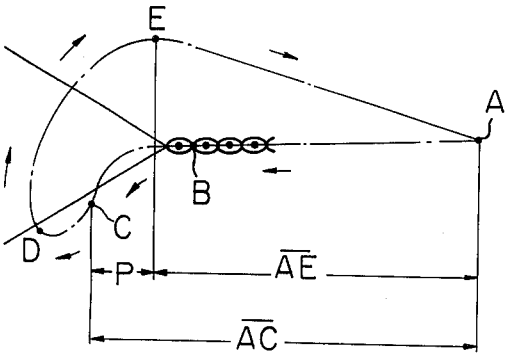
FIG. 5 is an explanatory sketch showing the movement of the grippers on the apparatus shown in FIG. 1, and FIGS. 6A through 6E are explanatory side elevational views of the grippers and their coacting parts showing the gripping operation in accordance with the present invention.
Figure 6A:
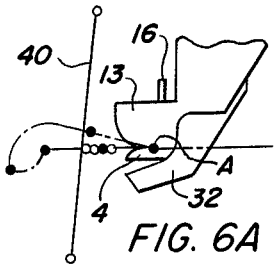
Figure 8A:
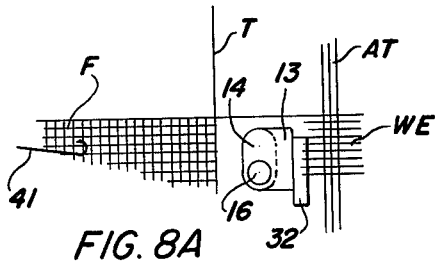
FIGS. 8A through 8E are explanatory partial top views of FIGS. 6A through 6E, respectively.

In the position illustrated in FIGS. 6A and 8A, the gripper is located in front of the cloth fell line (the border between the warps T and the fabric F) and a weft has just been inserted into the shed in a known manner. The gripper is at position A as illustrated in FIG. 5 and a new weft tucking cycle is about to begin. At this moment, the hooking needle 41 assumes a position forwardly of the cloth-fell line. The operation and structure of hooking needle 41 is well known and the cooperation between the hooking needle 41 and gripper 13, 14 will be described only schematically. While various hooking needle mechanisms may be utilized, one satisfactory mechanism is disclosed in U.S. Pat. No. 3,563,280.

Also illustrated in FIG. 8A are additional warps which are utilized to collect the cut weft ends WE. The additional warps form no part of the present invention and are only shown to illustrate one manner of collecting the cut weft ends.

Figure 6B:
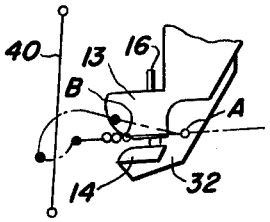

In order to grip the weft at the proper moment, the second rod 26 is pulled down by the control mechanism, the gripper slider 8 moves rearwardly (see arrow 40—FIG. 1) and the disposition of the apparatus changes from the position shown in FIG. 6A to that shown in FIG. 6B. Thus, the grippers 13 and 14 travel from the position A to the position B as shown in FIG. 5. In the meantime, the gripper roller 12 moves from the position A to the position B in FIG. 2. During this movement, the gripper roller 12 climbs onto the upper surface 6*a* of the gripper cam 6 (FIG. 2), the gripper lever 11 turns counterclockwise (in FIG. 1) about pin 9, causing nose 11*a* at the rear end of the gripper 11 to push down the operator rod 16 overcoming the force of spring 21 and the lower gripper 14 is pushed down in order to open the grippers.

Figure 8B:
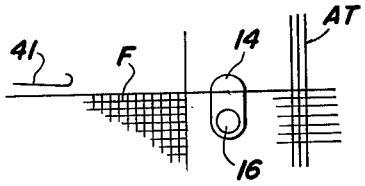

As best seen in FIG. 8B, when the gripper moves from position A to position B of FIG. 5, it moves rearwardly across the cloth-fell line in order to catch the inserted weft end W. At this point, grippers 13 and 14 are separated from each other and the hooking needle 41 is just entering the shed.

Figure 6C:
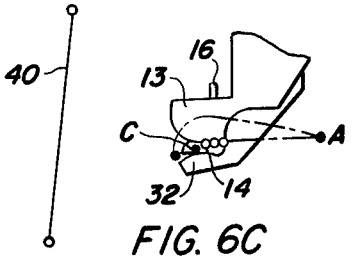

Next, the first rod 7 is pulled down by the control mechanism, the gripper bracket 3 swings about the pin 1, the grippers move downwardly and the disposition thereof changes from the position shown in FIG. 6B to that shown in FIG. 6C. As is clear from FIG. 2, the gripper roller 12 has left from the upper surface 6a of the gripper cam 6 in this disposition. As a result, the gripper lever 11 swings clockwise (in FIG. 1) about pin 9 and the operator rod 16 is liberated from the downward pressure of the nose 11a of gripper lever 11 and, thanks to the force exerted by the compressed spring 21, the lower gripper 14 is pulled up and brought into resilient pressure contact with the upper gripper 13 in order to grip the weft end.

Figure 8C:
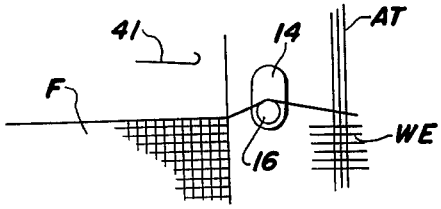
Figure 6D:
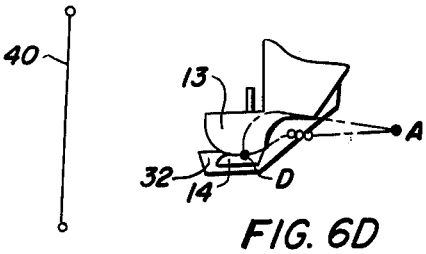
Figure 8D:
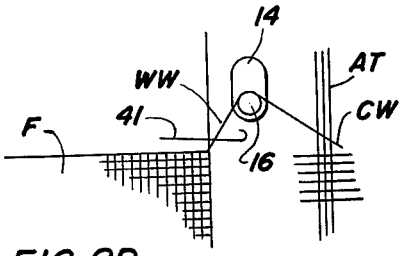
Figure 6E:
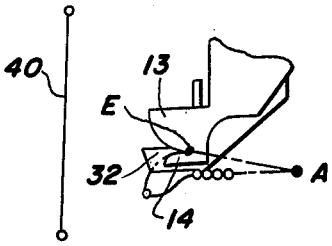
Figure 8E:
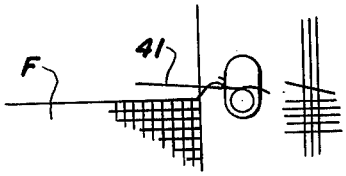

The position of the gripper with respect to fabric F is best viewed in FIG. 8C. At this point the weft has come into sufficient contact with the operator rod 16 and the gripper 14 is brought into contact with the upper gripper 13. The gripper weft has been moved rearwardly and downwardly from the cloth-fell line and the hooking needle 41 is completely within the shed.

After the weft has been firmly gripped by grippers 13 and 14, the gripper moves further rearwardly and downwardly towards position D of FIG. 5. As the gripper approaches this position, the cutting cam follower 31 moves to the forward flat position 27c of cam 28 causing cutter 32 to shear the weft end in cooperation with the sharp side edge of the upper gripper 13 (see FIG. 7A). At this moment, hooking needle 41 assumes a position above the woven weft and its hooking point has passed outwardly across the woven weft (see FIG. 8D).

After completion of the weft end cutting operation, the first and second rods 7 and 26 are pushed upwardly by their associated control mechanisms and, thereby, the grippers are moved forwardly and upwardly towards the position E shown in FIG. 5. In the meantime, the gripper roller 12 moves forwardly through the downside 6b of the gripper cam 6 while pushing up the latter overcoming the force by the return spring annexed to the gripper cam 6. Therefore, the gripper cam 6 is inoperative during this procedure and the grippers maintain the in closed state in order to hold the weft end. At the position E, the weft end comes into hooking engagement with the hook of the needle. Keeping this disposition, the needle advances into the open shed and the force caused thereby liberates the weft end being held by the grippers. In the meantime, the cutter roller 31 has already arrived at the forward flat portion 27a of the cam groove 27 of the cutter cam 28 (see FIG. 3), the cutter lever 29 swings clockwise in FIG. 4 and the cutter 32 resumes the open state.

After the grippers have passed the position E in FIG. 5, the first rod 7 is again pulled down by its associated control mechanism and the grippers move forwardly and downwardly in order to resume the initial disposition shown in FIG. 6A at the starting position A shown in FIG. 5.

By cyclic repetition of the aforementioned sequential operation, the prescribed tucked-in operation is carried out.

As is well understood from the foregoing explanation, employment of the present invention leads to a very simplified construction of the apparatus and assures reliable tucked-in operation and easy maintenance.

What is claimed is:

1. Apparatus for forming tucked-in type selvages on a shuttleless weaving loom comprising:
   - a gripper bracket pivoted at the loom framework at a position in front of a reed of the loom;
   - means responsive to a control mechanism for swinging said gripper bracket about its pivot;
   - a gripper slider movably mounted upon said gripper bracket in an arrangement slideable in the warp direction in a reciprocal manner;
   - means for reciprocating said gripper slider;
   - an upper gripper formed on the rear end of said gripper slider;
   - a movably mounted lower gripper disposed adjacent to the rear end of said gripper slider and spring loader into resilient pressure contact with said upper gripper for gripping an end of a weft which has been inserted into an open shed formed by the warps of the material being woven;
   - means positioned outside the region of movement of the reed for opening said grippers when said weft end is to be captured by said grippers, said opening means disposed adjacent said gripper bracket and said gripper slider;
   - a cutter pivoted at said gripper slider and having a cutting blade located adjacent to said grippers; and
   - means positioned outside of the region of movement of the reed for operating said cutter for cutting of said weft end, said means for operating said cutter disposed for movement with said gripper bracket and gripper slider.

2. The apparatus of claim 1 wherein said lower gripper is pivotally mounted on a common pivot with said cutter and is provided with a gripping surface cooperating with a surface on said gripper slider.

3. The apparatus of claim 2 wherein said common pivot is between the gripper surfaces and the forward end of said gripper sliders;
   - said cutter operating means and said gripper opening means each being a cam mounted upon said gripper brackets;
   - said cutter having an integral arm portion extending from said pivot toward and slideably engaging said cutter cam;
   - said gripper opening means comprising an arm extending from said common pivot towards said gripper opening means cam to make slideable engagement therewith.

4. Apparatus as claimed in claim 1 in which said means for swinging said gripper bracket comprises an arm projecting from said gripper bracket and a first rod connected to said arm.

5. Apparatus as claimed in claim 1 in which said gripper slider is slideably accommodated within a substantially horizontal guide groove formed in said gripper bracket.

6. Apparatus as claimed in claim 1 in which said means for sliding said gripper slider comprises a bracket fixed to said gripper slider, an L-shaped lever pivotally mounted at said loom framework and linked to said bracket via a connector and a second rod coupled at one end thereof to said L-shaped lever.

7. Apparatus as claimed in claim 1 in which said lower gripper is fixed to the bottom end of an operator rod, said operator rod is slidably and vertically carried by a rear projection of said gripper slider and an adjust collar and a set collar are annexed to said operator rod for adjustably limiting the movement of the operator rod.

8. Apparatus as claimed in claim 1 in which said grippers opening means comprises a gripper stand fixedly mounted to said gripper bracket and provided with a cam surface, a spring loaded gripper cam pivotally mounted to said gripper stand with its free end being in a resilient pressure contact with said cam surface of said gripper stand, a gripper lever pivoted at said gripper slider in such an arrangement that the rear end thereof is operable upon said lower gripper and a gripper roller rotatably disposed to the other end of said gripper stand and said gripper cam.

9. Apparatus as claimed in claim 8 in which the set position of said gripper stand on said gripper bracket is adjustable in the warp direction.

10. Apparatus as claimed in claim 8 in which said cam surface of said gripper stand is composed of a forward flat portion, a rear flat portion and a slope lowering rearwardly and connecting said two portions.

11. Apparatus as claimed in claim 8 in which said gripper cam is so arranged as to be inoperative upon said gripper roller when the latter moves forwardly.

12. Apparatus as claimed in claim 1 in which said cutter operating means comprises a cutter cam fixedly mounted to said gripper bracket and provided with a cam groove, a cutter lever pivoted at said gripper slider, one end of which is joined by pin to said cutter lever and accomodated within said cam groove of said cutter cam.

13. Apparatus as claimed in claim 12 in which said cam groove of said cutter cam is composed of a forward flat portion, a rear flat portion and a slope rising rearwardly and connecting said two portions.

* * * * *

UNITED STATES PATENT AND TRADEMARK OFFICE

CERTIFICATE OF CORRECTION

PATENT NO. : 4,090,535

DATED : May 23, 1978

INVENTOR(S) : Toyo Nakanishi

It is certified that error appears in the above-identified patent and that said Letters Patent are hereby corrected as shown below:

Assignee: TSUDAKOMA KOGYO KABUSHIKI KAISHA,

Kanazawa-shi, Ishikawa-ken, Japan

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*